US010408118B2

(12) United States Patent
DeVenney et al.

(10) Patent No.: US 10,408,118 B2
(45) **Date of Patent: *Sep. 10, 2019**

(54) ENGINE COOLANT MONITORING SYSTEM FOR A MACHINE

(71) Applicant: Caterpillar Inc., Peoria, IL (US)

(72) Inventors: Thomas J. DeVenney, Sheffield, IL (US); Douglas P. Hunsicker, Chillicothe, IL (US)

(73) Assignee: Caterpillar Inc., Deerfield, IL (US)

( * ) Notice: Subject to any disclaimer, the term of this patent is extended or adjusted under 35 U.S.C. 154(b) by 444 days.

This patent is subject to a terminal disclaimer.

(21) Appl. No.: 15/097,421

(22) Filed: Apr. 13, 2016

(65) Prior Publication Data

US 2017/0298806 A1 Oct. 19, 2017

(51) Int. Cl.
*F01P 11/14* (2006.01)

(52) U.S. Cl.
CPC ..... *F01P 11/14* (2013.01); *F01P 2025/80* (2013.01)

(58) Field of Classification Search
CPC ..... F01P 11/14; F01P 2025/80
USPC ..... 73/114.68; 702/50
See application file for complete search history.

(56) References Cited

U.S. PATENT DOCUMENTS 4,164,474 A * 8/1979 Gallacher ..... C07C 303/32 252/389.61
4,434,233 A * 2/1984 Bzdula ..... G01N 33/2835 324/439
4,616,503 A * 10/1986 Plungis ..... G01N 11/06 73/54.08
5,080,815 A * 1/1992 Fenoglio ..... C07D 249/14 508/190
5,089,780 A * 2/1992 Megerle ..... G01N 33/2888 324/444
5,889,200 A * 3/1999 Centers ..... G01N 27/06 324/693
6,526,335 B1 * 2/2003 Treyz ..... G01C 21/26 307/10.1

(Continued)

OTHER PUBLICATIONS

Beal, Engine Coolant Testing, 1993, ASTM.*

(Continued)

*Primary Examiner* — Eric S. McCall
*Assistant Examiner* — Timothy P Graves
(74) *Attorney, Agent, or Firm* — Finnegan, Henderson, Farabow, Garrett & Dunner, LLP

(57) ABSTRACT

An engine coolant monitoring system for a machine is disclosed. The engine coolant monitoring system may have a test device configured to test a fluid sample of an engine coolant. The engine coolant monitoring system may also have a database configured to store a test result generated by the test device, the test result including a plurality of characteristics of the fluid sample. In addition, the engine coolant monitoring system may have a controller. The controller may be configured to access a rule-set associated with the engine coolant from the database, the rule-set having criteria associated with the characteristics. The controller may also be configured to label the engine coolant as normal when the characteristics of the fluid sample satisfy the criteria and label the engine coolant as abnormal when the characteristics do not satisfy at least one criterion included in the rule-set.

20 Claims, 8 Drawing Sheets

(56) References Cited

U.S. PATENT DOCUMENTS

| | | | | |
|---|---|---|---|---|
| 6,645,438 | B1 * | 11/2003 | Dubrovsky | B01J 19/088 204/168 |
| 8,965,625 | B2 | 2/2015 | Dvorak et al. | |
| 2003/0173970 | A1 * | 9/2003 | Horie | G01N 33/2888 324/438 |
| 2005/0287677 | A1 * | 12/2005 | Bosmann | G01N 27/44 436/163 |
| 2010/0300188 | A1 * | 12/2010 | Halalay | G01N 33/2888 73/114.55 |
| 2013/0303409 | A1 * | 11/2013 | Kapps | G01N 30/24 506/39 |
| 2014/0365144 | A1 * | 12/2014 | Dvorak | G01N 33/2888 702/50 |
| 2017/0197596 | A1 * | 7/2017 | Barnes | B60S 5/00 |

OTHER PUBLICATIONS

U.S. Patent Application of Thomas J. DeVenney et al., filed Apr. 13, 2016, for "Maintenance System for a Machine Using Fluid Sample Monitoring,".

* cited by examiner

ENGINE COOLANT MONITORING SYSTEM FOR A MACHINE

TECHNICAL FIELD

The present disclosure relates generally to a monitoring system for a machine, and, more particularly, to an engine coolant monitoring system for a machine.

BACKGROUND

Earth-moving machines, for example, excavators, shovels, continuous miners, loaders, trucks, etc., include a power source that provides power for propelling the machines and for operation of one or more work tools of the machine. The power source typically includes an internal combustion engine. Operation of the engine may require a variety of fluids other than fuel. For example, the engine may require engine lubricant for lubrication of the engine moving parts. The engine lubricant may accumulate soot and/or debris generated due to wear of the engine components as the engine lubricant circulates within the engine. The engine lubricant may also burn, decompose, and/or degrade because of exposure to high temperatures in the engine. The engine may also employ an engine coolant for cooling the combustion chambers of the engine. Like the engine lubricant, the engine coolant may also accumulate debris and may degrade or decompose because of exposure to high temperatures generated in the engine.

Power may be transferred from the engine to wheels or tracked undercarriages of the machine via a transmission and gearbox system. The transmission and gear box system may employ transmission fluid and/or gear oil for lubrication. In some cases, power may be transferred to the wheels or tracked undercarriages by hydraulic pumps or motors, which may be driven by the engine, and which may direct hydraulic fluid to drive the wheels or tracked undercarriages. Further, power may be transferred from the engine to various work tools of the machine via hydraulic pumps or motors, which may direct pressurized hydraulic fluid into or out of hydraulic cylinders associated with the work tools. The transmission fluid, gear oil, and/or hydraulic fluid may also accumulate dirt and debris as the fluid circulates through various components. Furthermore, the transmission fluid, gear oil, and/or hydraulic fluid may decompose or degrade as it circulates through the pumps, motors, and/or work tools. The machines may include other fluids, for example, brake fluid used in braking systems associated with the machines. Although the different fluids in the machines typically flow through their respective closed-loop circuits, one or more of the fluids may intermingle if leaks are present in the engine, transmission, hydraulic pumps and motors, conduits carrying the various fluids etc.

The various fluids, for example, engine lubricant, coolant, transmission fluid, gear oil, brake fluid, and/or hydraulic fluid may be periodically replaced or topped off as part of a predetermined maintenance schedule. The predetermined maintenance schedule, however, may not account for the rate of debris accumulation, decomposition, and/or degradation of the one or more fluids because of the operating environment, load conditions, or wear rate of a particular machine. Thus, one or more of the fluids may need to be replaced or topped off before the predetermined maintenance period. Alternatively, the fluids may not need to be replaced according to the predetermined maintenance schedule when, for example, the machine has not been used or when the machine is new. In some cases, early failure of one or more of engine, transmission, or hydraulic components may require unscheduled maintenance, requiring the machine to be removed from service. Moreover, it may be difficult to detect the presence of leaks, which may cause the fluids to intermingle during a scheduled or unscheduled maintenance of the machine. Thus, it may be desirable to determine a fluid condition of one or more of the fluids in the machine and/or a component condition of machine components subject to wear so that maintenance activities may be scheduled with minimum disruption in the use of the machine. Further, it may be desirable to detect the presence of leaks in one or more engine systems so that appropriate repairs may be carried out before catastrophic failure of one or more engine components.

U.S. Pat. No. 8,965,625 B2 to Dvorak et al. ("the '625 patent") that issued on Feb. 24, 2015, discloses a system for predicting a portion of used lubricant in an engine that is to be drained and replaced with fresh lubricant. The '625 patent discloses receiving a first input of an analysis characteristic value from the used lubricant. According to the '625 patent, the analysis characteristic value may consist of amounts of various elements (e.g. iron, lead, tin, etc.), water, fuel, sludge, insolubles, etc. The '625 patent also discloses receiving a second input consisting of an analysis characteristic threshold. The '625 patent discloses a process for predicting a future analysis characteristic value based on the two received inputs and historical characteristic values. The '625 patent also discloses determining whether the predicted characteristic value exceeds the characteristic threshold. Further, the '625 patent discloses determining an amount of lubricant that should be replaced to extend the lubricant life to a future predetermined service interval.

Although the '625 patent discloses the use of lubricant sample analysis, the disclosed systems and methods may still not be optimal. In particular, the systems and methods of the '625 patent rely on analysis of each analysis characteristic individually, ignoring the impact of more than one analysis characteristic on the maintenance schedule. Furthermore, the systems and methods of the '625 patent determine whether to replace or top off the lubricant when the machine has already been removed from service for maintenance. Additionally, the disclosed systems and methods do not determine whether repair or replacement of one or more machine components is required.

The engine coolant monitoring system of the present disclosure solves one or more of the problems set forth above and/or other problems in the art.

SUMMARY

In one aspect, the present disclosure is directed to an engine coolant monitoring system for a machine. The engine coolant monitoring system may include a test device configured to test a fluid sample of an engine coolant from the machine. The engine coolant monitoring system may also include a database configured to store a test result generated by the test device, the test result including a plurality of characteristics of the fluid sample. In addition, the engine coolant monitoring system may include a controller. The controller may be configured to access a rule-set associated with the engine coolant from the database. The rule-set may include criteria associated with the characteristics. The controller may be further configured to determine whether characteristics of the fluid sample satisfy the criteria. The controller may also be configured to label the engine coolant as normal when the characteristics of the fluid sample satisfy the criteria and label the engine coolant as abnormal when the characteristics do not satisfy at least one criterion included in the rule-set.

In another aspect, the present disclosure is directed to a method of monitoring engine coolant in a machine. The method may include extracting a fluid sample of the engine coolant from the machine. The method may also include testing the fluid sample using at least one test apparatus. Further, the method may include generating a test result, including a plurality of characteristics of the fluid sample. The method may include storing the test result in a database. The method may further include accessing, using a controller, a rule-set associated with the engine coolant from the database, the rule-set including criteria associated with the characteristics. The method may also include determining whether characteristics of the fluid sample satisfy the criteria. In addition, the method may include labeling the engine coolant as normal when the characteristics of the fluid sample satisfy the criteria, and labeling the engine coolant as abnormal when the characteristics do not satisfy at least one criterion included in the rule-set.

DETAILED DESCRIPTION

Figure 1:
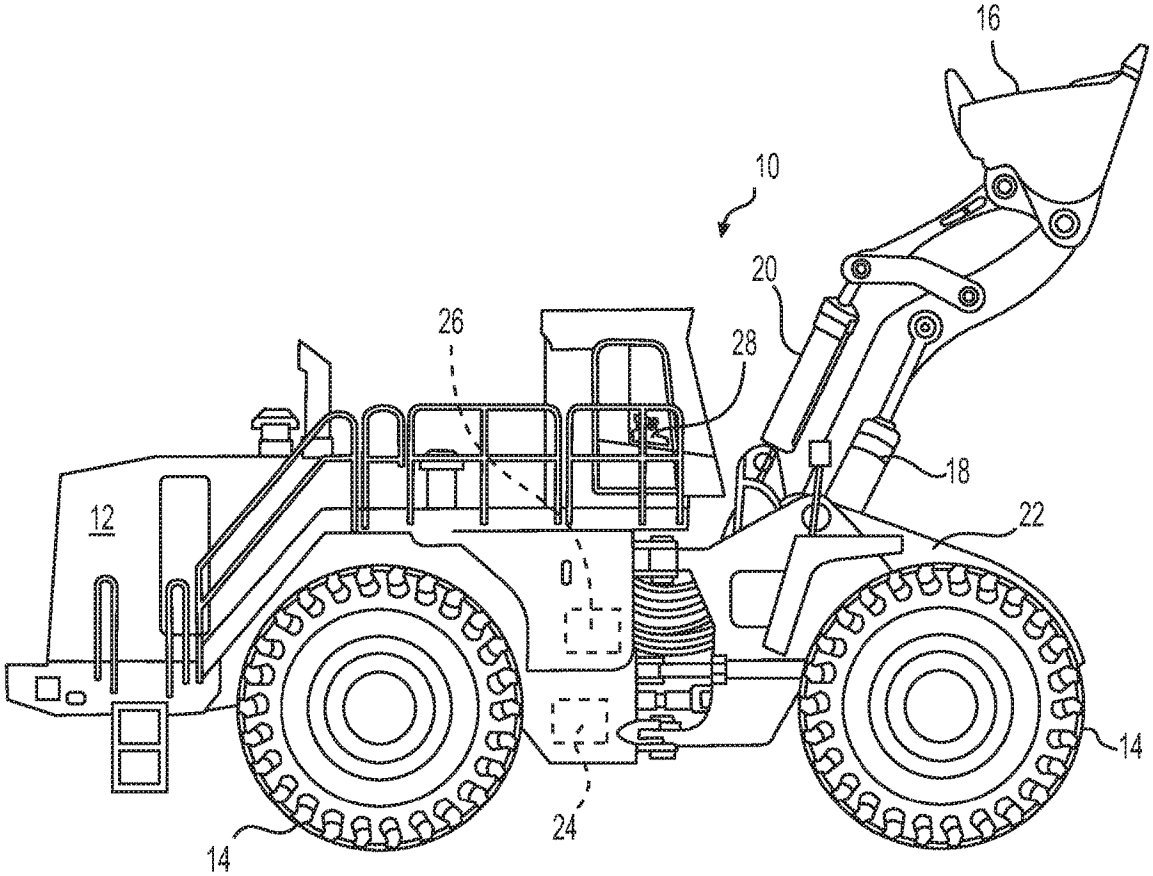
FIG. 1 is a pictorial illustration of an exemplary disclosed machine.

FIG. 1 illustrates an exemplary embodiment of a machine 10. In the disclosed example, machine 10 is a load-haul-dump machine (LHD). It is contemplated, however, that machine 10 could embody another type of machine (e.g., a wheel loader, dozer, truck, excavator, shovel). Machine 10 may include, among other things, a power source 12 (e.g. engine), one or more traction devices 14 (e.g. wheels), a work tool 16, one or more lift actuators 18, and one or more tilt actuators 20. Lift actuators 18 and tilt actuators 20 may connect work tool 16 to frame 22 of machine 10. Lift actuators 18 and tilt actuators 20 may be configured to manipulate work tool 16 by raising or lowering work tool 16 and/or inclining work tool 16 relative to machine 10.

Power source 12 may be supported by frame 22 of machine 10, and may include an engine 12 configured to produce a rotational power output and transmission 24 that converts the power output to a desired ratio of speed and torque. In addition to driving work tool 16, engine 12 may also function to propel machine 10, for example via one or more traction devices 14. In some exemplary embodiments, rotational power output from engine 12 and/or transmission 24 may be used to drive one or more pumps (not shown) that supply pressurized hydraulic fluid to lift actuators 18, tilt actuators 20, and/or to one or more hydraulic motors associated with traction devices 14. Engine 12 may be a combustion engine configured to burn a mixture of fuel and air, the amount and/or composition of which directly corresponds to the rotational power output of engine 12. Engine 12 may include engine lubricant for lubricating various engine components.

Transmission 24 may be configured to communicate the rotational power output of engine 12 to traction devices 14. Transmission 24 may take any form known in the art, for example a power shift configuration that provides multiple discrete operating ranges, a continuously variable configuration, or a hybrid configuration. Transmission 24 may include transmission oil that may lubricate various components of transmission 24. Transmission 24 may further include gear box 26, which may include gear oil for lubrication of gears (not shown) in gear box 26. In some exemplary embodiments, both transmission 24 and gear box 26 may be lubricated by the same oil, which may be transmission oil or gear oil.

Numerous different work tools 16 may be operatively attachable to a single machine 10 and driven by engine 12. Work tool 16 may include any device used to perform a particular task such as, for example, a bucket, a fork arrangement, a blade, a shovel, or any other task-performing device known in the art. Although connected in the embodiment of FIG. 1 to lift and tilt relative to machine 10, work tool 16 may alternatively or additionally rotate, slide, swing open/close, or move in any other manner known in the art. Lift and tilt actuators 18, 20 may be extended or retracted to repetitively move work tool 16 during an excavation cycle.

Figure 2:
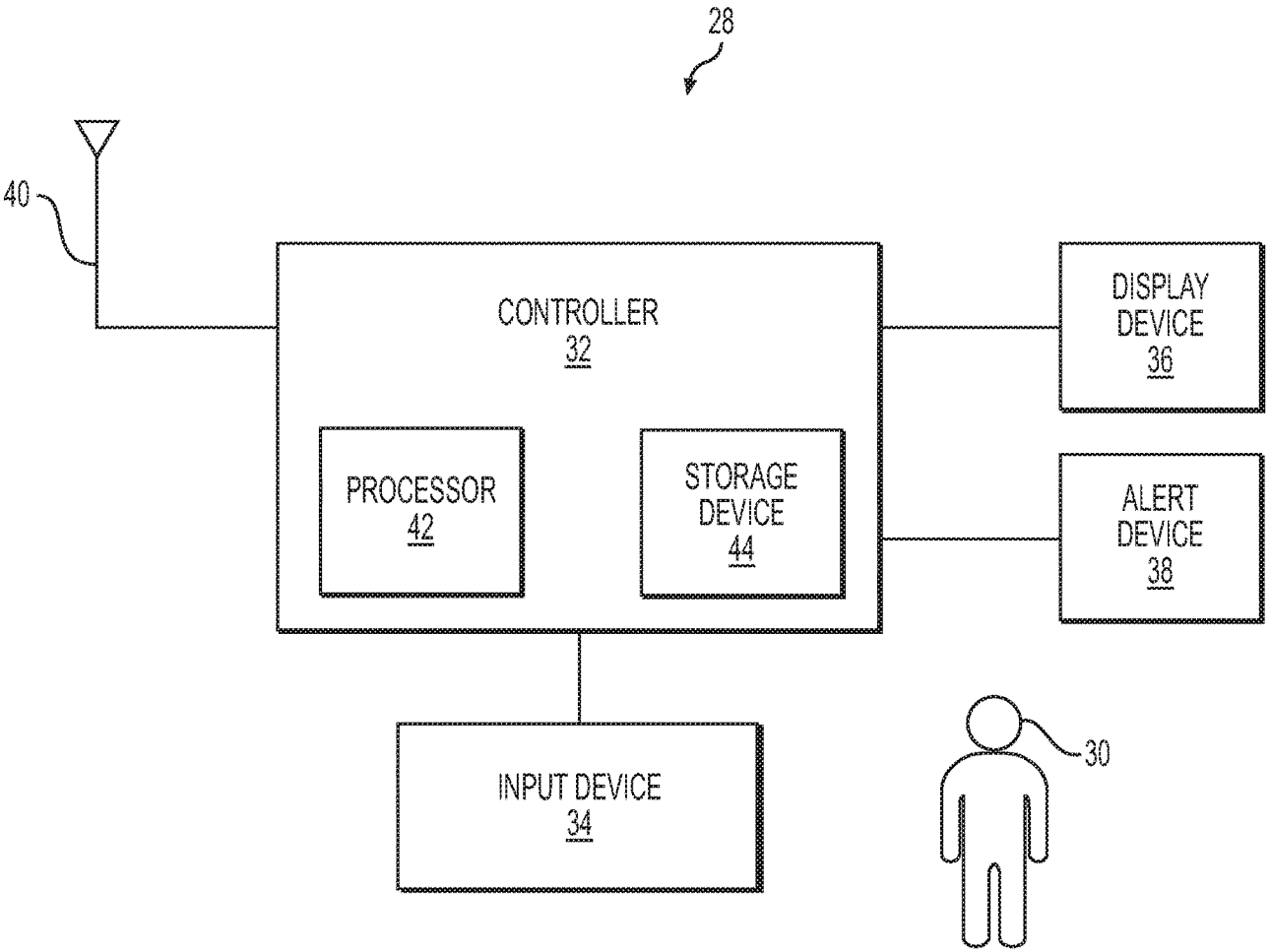
FIG. 2 is a schematic illustration of an exemplary disclosed console that may be used with the machine of FIG. 1.

Machine 10 may include console 28 that may be configured to allow operator 30 (see FIG. 2) of machine 10 to control various aspects of machine 10, for example, engine 12, lift and tilt actuators 18, 20, work tool 16, transmission 24, gear box 26, etc. FIG. 2 illustrates a schematic view of an exemplary console 28 of machine 10. As illustrated in FIG. 2, console 28 may include controller 32, input device 34, display device 36, alert device 38, and communication device 40. Controller 32 may include processor 42 and storage device 44. Processor 42 may be configured to control operations of storage device 44, display 36, alert device 38, and communication device 40. Storage device 44 may store data and/or instructions that processor 42 may be configured to execute to perform a variety of operations.

Processor 42 may embody a single or multiple microprocessors, digital signal processors (DSPs), etc. Numerous commercially available microprocessors can be configured to perform the functions of processor 42. Various other known circuits may be associated with processor 42, including power supply circuitry, signal-conditioning circuitry, and communication circuitry. Storage device 44 may embody non-transitory computer-readable media, for example, Random Access Memory (RAM) devices, NOR or NAND flash memory devices, and Read Only Memory (ROM) devices, CD-ROMs, hard disks, floppy drives, optical media, solid state storage media, etc.

One or more input devices 34 may also be associated with controller 32. Controller 32 may receive inputs from operator 30 via input device 34 and may perform operations based on the received inputs. In one exemplary embodiment, input device 34 may enable operator 30 of console 28 to provide inputs to controller 32 for controlling, for example, engine 12, lift and tilt actuators 18, 20, work tool 16, transmission 24, gear box 26, etc. Input device 34 may also enable operator 30 to provide numerical, textual, graphic, or audio-visual inputs to controller 32. Input device 34 may include a physical keyboard, virtual touch-screen keyboard, mouse, joystick, stylus, etc. In certain embodiments, input device 34 may also include one or more microphones (not shown) using, for example, speech-to-text and/or voice recognition applications.

One or more display devices 36 may be associated with controller 32 and may be configured to display textual or graphical data or information in cooperation with processor 42. For example, display device 36 may be configured to display information generated by processor 42 or information received via communication device 40. Display device 36 may be a cathode ray tube (CRT) monitor, a liquid crystal display (LCD), a light emitting diode (LED) display, a projector, a projection television set, a touchscreen display, or any other kind of display device known in the art.

Alert device 38 may be associated with controller 32, and may be configured to generate an audible alert (e.g. beep or other sound), a visual alert (e.g. colored light, colored graphic or icon), or an audio-visual alert (e.g. graphic or icon accompanied by sound) based on instructions received from processor 42. Alert device 38 may be a separate device, or may be incorporated in display device 36 to provide one or more alerts to operator 30 of console 28. Communication device 40 of console 28 may be configured to wirelessly send or receive data and/or instructions. Communication device 40 may include hardware and/or software that enable the sending and/or receiving of data messages through a communications link. The communications link may include satellite, cellular, infrared, radio, and/or any other type of wireless communications. In one exemplary embodiment as illustrated in FIG. 2, communication device 40 may include an antenna.

Although, controller 32, input device 34, display device 36, alert device 38, and communication device 40 have been described separately, it is contemplated that controller 32, input device 34, display device 36, alert device 38, and communication device 40 may be integrated into a single console 28. Further, although FIG. 2 illustrates only one each of controller 32, input device 34, display device 36, alert device 38, and communication device 40, it is contemplated that console 28 may include any number of controllers 32, input devices 34, display devices 36, alert devices 38, and communication devices 40. It is also contemplated that controllers 32, input devices 34, display devices 36, alert devices 38, and communication devices 40 may form part of a laptop computer, a tablet computer, or any other type of electronic or mobile device known in the art that may be fixed to or removable from machine 10. Console 28 may be used to control machine 10 remotely or from on board machine 10.

Figure 3:
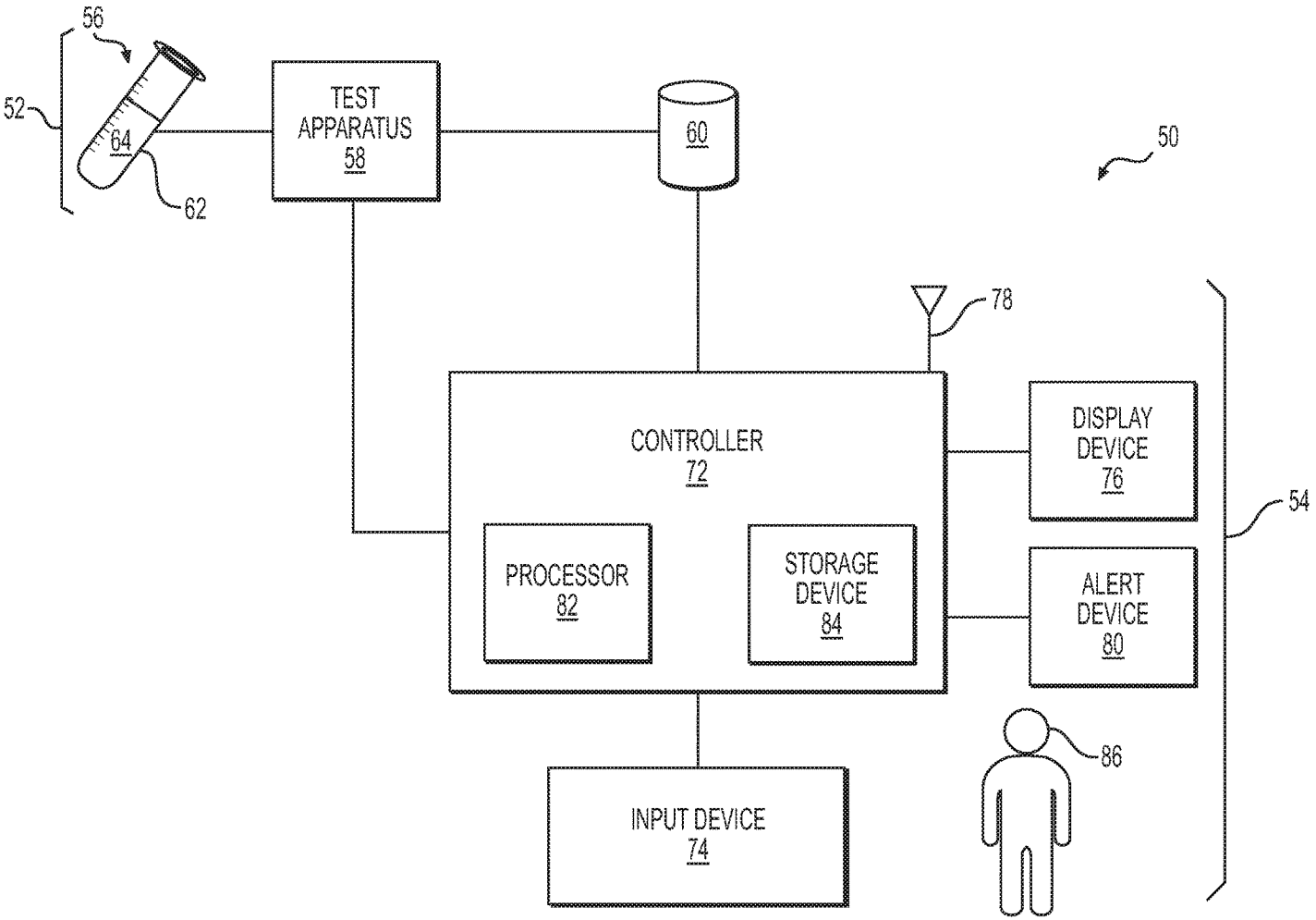
FIG. 3 is a flow chart illustrating an exemplary disclosed maintenance system for the machine of FIG. 1.

FIG. 3 illustrates a schematic view of an exemplary maintenance system 50 that may be used with machine 10. Maintenance system 50 may include measurement system 52 and analysis system 54. Measurement system 52 may include fluid container 56, test apparatus 58, and database 60. Fluid container 56 may include fluid sample 64, which may include a small volume of, for example, engine lubricant, transmission oil, gear oil, hydraulic fluid, brake fluid, engine coolant etc. Fluid sample 64 may be obtained from one or more components of machine 10, when machine 10 is taken out of service, or without taking machine 10 out of service. For example, fluid sample 64 may be collected by operator 30 and/or owner of machine 10 periodically (e.g. every day, every week, every month, etc.).

Test apparatus 58 may include one or more devices configured to perform a variety of tests on fluid sample 64. Test apparatus 58 may be configured to determine, for example, an amount of water, an amount of debris (e.g. precipitate, insolubles, etc.), an amount of one or more of elements (e.g. iron, aluminum, silicon, copper, chromium, sodium, potassium, lead zinc, tin, etc.), and/or an amount of compounds (e.g. oil, ammonia, glycol, etc.) present in fluid sample 64. Test apparatus 58 may also be configured to determine a color, density, opacity, transmissivity, absorptivity, viscosity, conductivity, vaporization temperature, acidity or basicity, a pH value, an amount of foam, and/or other physical characteristics of fluid sample 64 known in the art.

Test apparatus 58 may include one or more of titration instruments, liquid chromatography devices, gas chromatography devices, inductively coupled spectrometers, viscometers, light extinction particle counters, pH meters, refractometers, conductivity measurement devices, and/or other fluid property test apparatuses known in the art. One or more test apparatuses 58 may be used to determine a plurality of characteristics of fluid sample 64, which may collectively comprise a test result for fluid sample 64. For example, one or more titration instruments may be used to determine a total base number (TBN) of fluid sample 64, a total acid number (TAN) of fluid sample 64, an amount of water in fluid sample 64, etc. The total base number may provide an estimate of an amount of additives in fluid sample 64 that may be capable of neutralizing acidic components generated during combustion. Likewise, the total acid number may provide an estimate of an amount of additives in fluid sample 64 that may be capable of neutralizing acidic components generated during combustion. Other characteristics of fluid sample 64 may include an amount of fuel, oil, or glycol determined using, for example, one or more gas chromatography devices. Characteristics of fluid sample 64 may include amounts of elements such as copper (Cu), iron (Fe), chromium (Cr), lead (Pb), aluminum (Al), silicon (Si), molybdenum (Mo), magnesium (Mg), nickel (Ni), zinc (Zn), tin (Sn), sodium (Na), calcium (Ca), phosphorus (P), potassium (K), barium (Ba), boron (B), Cadmium (Cd), manganese (Mn), silver (Ag), titanium (Ti), vanadium (V), etc., which may be determined using, for example, one or more inductively coupled spectrometers. The amounts of water, fuel, oil, glycol, and various elements may be expressed in absolute units of mass or volume or in terms of a percentage based on a mass or volume of fluid sample 64. The amounts may also be expressed in terms of parts per million present in fluid sample 64.

Database 60 may include one or more logically and/or physically separate databases configured to store data and/or instructions. Data stored in database 60 may include one or more test results for one or more fluid samples 64. Test results stored in database 60 may be received from test apparatus 58, controller 32 of machine 10, analysis system 54, and/or may be provided as input using conventional methods (e.g., data entry, data transfer, data uploading, etc.) In one exemplary embodiment, database 60 may be implemented using a non-transitory computer-readable storage medium. In another exemplary embodiment, database 60 may be maintained in a network attached storage device, in a storage area network, or combinations thereof, etc. In yet another exemplary embodiment, database 60 may store the data on storage devices, which may include, for example, hard drives, RAID arrays, solid state drives, NOR or NAND flash memory devices, and/or Read Only Memory (ROM) devices. Furthermore, database 60 may be maintained and queried using numerous types of database software and programming languages, for example, SQL, MySQL, IBM DB2®, Microsoft Access®, PERL, C/C++, Java®, etc.

An identifier (numeric or alphanumeric) corresponding to fluid sample 64 may be stored in database 60. In some exemplary embodiments, database 60 may also store a model number or description, a serial number, a model year, and/or other sales or ownership related information corresponding to machine 10 from which fluid sample 64 is extracted. Database 60 may store the identifier of fluid sample 64 in association with the model number or description, the serial number, the model year, and/or other sales or ownership related information corresponding to machine 10. Database 60 may also store test results, including characteristics of fluid sample 64 determined using the one or more test apparatuses 58, in association with the identifier of fluid sample 64.

Figure 4:
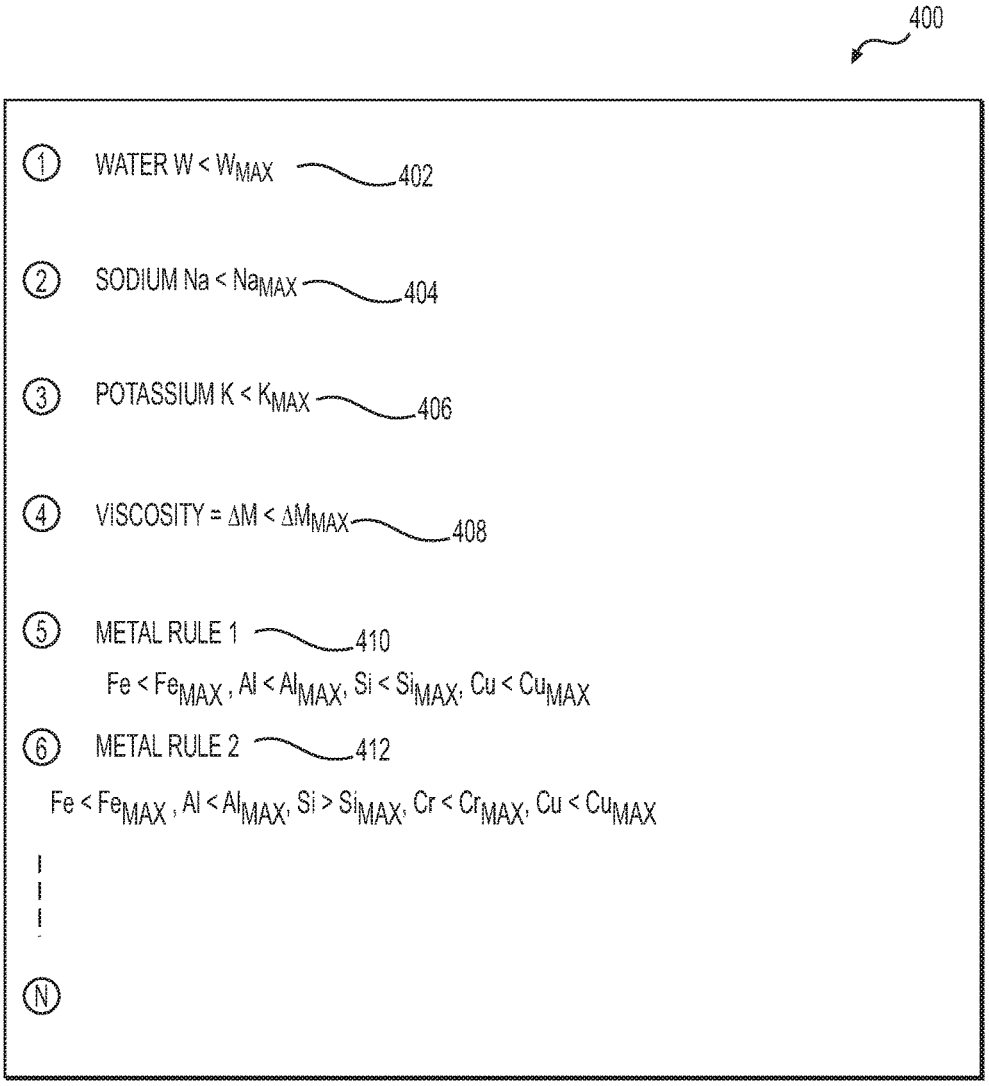
FIG. 4 is a pictorial illustration of an exemplary rule-set used by the maintenance system of FIG. 3 for fluids, such as, engine lubricant, transmission oil, gear oil, brake fluid, or hydraulic fluid.
Figure 5:
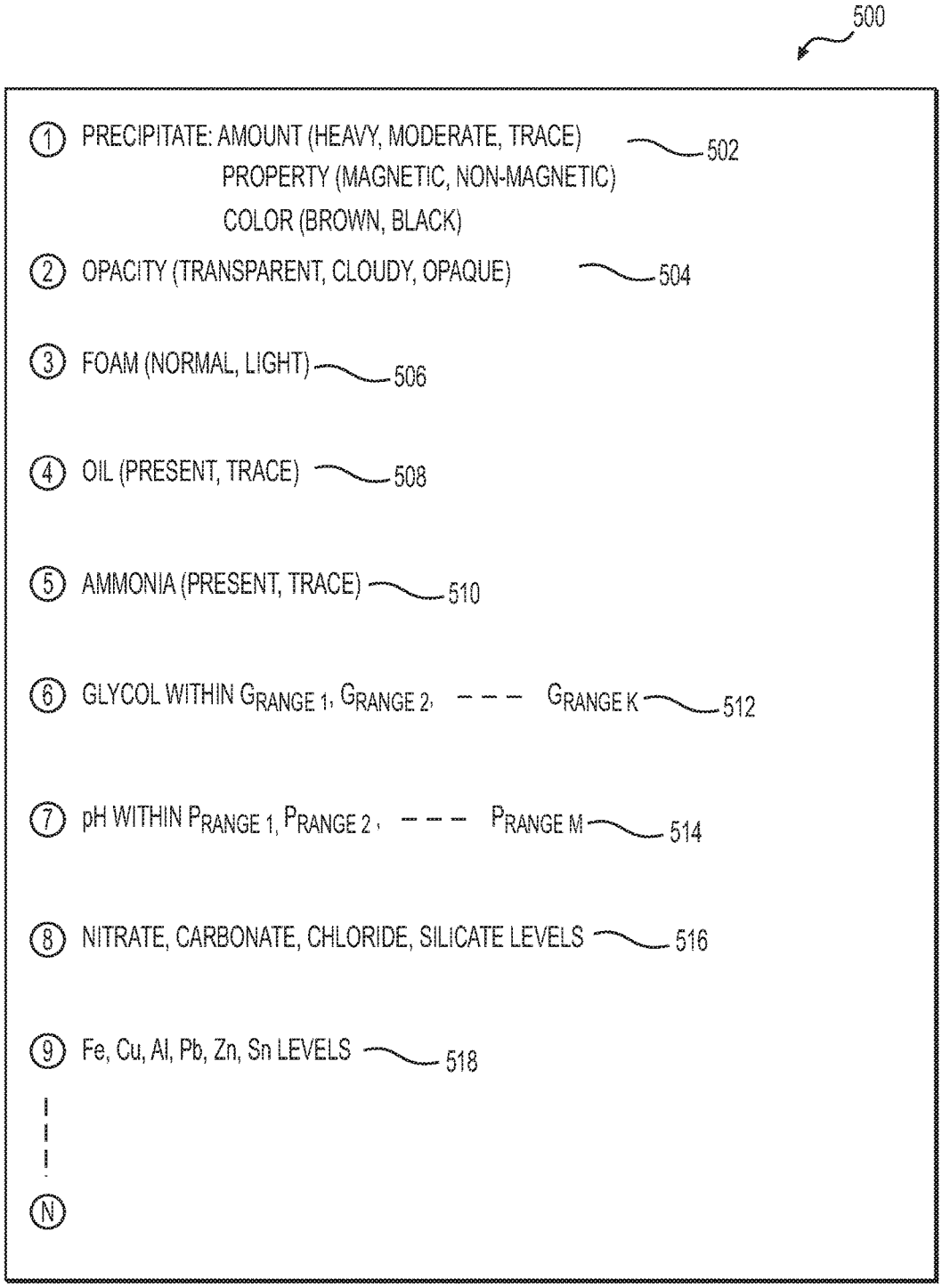
FIG. 5 is a pictorial illustration of an exemplary rule-set used by the maintenance system of FIG. 3 for an engine coolant.

Database 60 may further store one or more rule-sets 400 (FIG. 4) or 500 (FIG. 5). Rule-set 400 may be applicable to fluids including engine lubricant, transmission oil, gear oil, hydraulic fluid, brake fluid, etc. As illustrated in FIG. 4, rule-set 400 may include a plurality of rules 402-412 associated with the one or more characteristics of fluid sample 64 determined using test apparatuses 58. As illustrated in FIG. 4, each of rules 402-412 in rule-set 400 may provide one or more criteria (or conditions) related to the one or more characteristics of fluid sample 64. For example, rules 402-412 may compare measured values of characteristics of fluid sample 64 with corresponding threshold values. In one exemplary embodiment as illustrated in FIG. 4, rule 402 of rule-set 400 may relate to a characteristic representing an amount of water in fluid sample 64. Rule 402 may be satisfied, for example, when a value "W" representing the amount of water in fluid sample 64 is less than a water threshold "$W_{MAX}$."

Rule 404 of rule-set 400 may relate to a characteristic representing an amount of sodium. Rule 404 may be satisfied, for example, when an amount of sodium "Na" in fluid sample 64 is less than a sodium threshold "$Na_{MAX}$." Rule 406 of rule-set 400 may relate to a characteristic representing an amount of potassium. Rule 406 may be satisfied, for example, when an amount of potassium "K" in fluid sample 64 is less than a potassium threshold "$K_{MAX}$." Rule 408 of rule-set 400 may related to a characteristic representing a change in viscosity. Rule 408 may be satisfied when a measured viscosity change "$\Delta\mu$" is less than a viscosity change threshold "$\Delta\mu_{MAX}$." The change in viscosity $\Delta\mu$ may be determined by comparing a current viscosity "$\mu_{current}$" of fluid sample 64 with a previous value of viscosity "$\mu_{previous}$" stored in database 60. In one exemplary embodiment, $\mu_{previous}$ may represent a historical value of viscosity of fluid samples of fluids similar to that in fluid sample 64 obtained from a particular machine 10. In another exemplary embodiment, $\mu_{previous}$ may represent a historical value of viscosity of fluid samples 64 obtained from many machines similar to machine 10. The previous value of viscosity $\mu_{previous}$ may be an average value, a maximum value, a minimum value, or may represent any other statistical measure known in the art.

Rules 410 and 412 of rule-set 400 may define first and second metal rules, respectively. First metal rule (rule 410) may be satisfied, for example, when one or more of Fe (an amount of iron), Al (an amount of aluminum), Si (an amount of silicon), and Cu (an amount of copper) are less than their corresponding threshold values "$Fe_{MAX}$," "$Al_{MAX}$," "$Si_{MAX}$," and "$Cu_{MAX}$," respectively. Second metal rule (rule 412) may be similar to rule 410 and may be satisfied when Cr (an amount of chromium) is less than a chromium threshold "$Cr_{MAX}$," in addition to the criteria for the other elements specified in first metal rule 410. In one exemplary embodiment as illustrated in FIG. 4, second metal rule 412 may also specify that the amount of silicon Si should be greater than or equal to a silicon threshold $Si_{MAX}$. It is contemplated that first and second metal rules 410, 412 may include fewer than or more than elements iron, aluminum, silicon, copper, and chromium illustrated in FIG. 4. It is also contemplated that first and second metal rules 410, 412 may include rules for elements other than the elements, iron, aluminum, silicon, copper, and chromium, illustrated in FIG. 4. Although only rules 402-412 have been illustrated in FIG. 4, it is contemplated that rule-set 400 may include any number of rules. It is contemplated that database 60 may store different rule-sets 400 for different fluids, for example, engine lubricant, transmission oil, gear oil, brake fluid, hydraulic fluid, etc. It is also contemplated, however, that the same rule-set 400 may be applicable to one or more of an engine lubricant, transmission oil, gear oil, brake fluid, and hydraulic fluid.

In one exemplary embodiment, fluid sample 64 may be labeled "Normal," only when a test result corresponding to fluid sample 64 satisfies each of the plurality of rules (e.g. 402-412), in rule-set 400. Fluid sample 64 may be labeled "Abnormal" when the test result for fluid sample 64 does not satisfy at least one of the rules 402-412 in rule-set 400. In another exemplary embodiment, fluid sample 64 may be labeled "Normal," when fluid sample 64 satisfies a subset of rules selected from rule-set 400. For example, fluid sample 64 may be labeled "Normal" when a test result of fluid sample 64 satisfies rules 402-404 and at least one of first and second metal rules 410, 412, and may be labeled "Abnormal" when the test result of fluid sample 64 does not satisfy at least one of rules 402-404, 410, or 412.

FIG. 5 illustrates an exemplary rule-set 500 that may be associated with an engine coolant of machine 10 and that may be stored in database 60. It is contemplated that database 60 may store different rule-sets 500 for different types of engine coolants used in engines 12. The different types of engine coolant may include, for example, conventional engine coolants, diesel engine antifreeze, coolant (DEAC), extended life coolant (ELC), etc. In other exemplary embodiments, the same rule-set 500 may be applicable to many different types of engine coolants.

As illustrated in FIG. 5, rule-set 500 may include a plurality of rules, for example, rules 502-518. Each of rules 502-518 in rule-set 500 may provide one or more criteria (or conditions) related to one or more characteristics of fluid sample 64 determined by test apparatus 58. For example, rules 502-518 may compare a value of a characteristic of fluid sample 64, determined by test apparatus 58, with a threshold value of that characteristic stored in database 60. As illustrated in FIG. 5, rule 502 of rule-set 500 may relate to amounts and characteristics of solid material (e.g. precipitate) found in fluid sample 64. The solid material may include dust, debris, metal particles, or other materials that do not dissolve in fluid sample 64. According to rule 502 an amount of solid material in fluid sample 64 may be classified as "Heavy," "Moderate," or "Trace." For example, the amount of solid material in fluid sample 64 may be labeled "Trace," when it is less than a first solid threshold. The amount of solid material in fluid sample 64 may be labeled "Moderate," when the amount of solid material in fluid sample 64 ranges between the first solid threshold and a second solid threshold. The amount of solid material in fluid sample 64 may be labeled "Heavy," when the amount of solid material in fluid sample 64 exceeds the second solid threshold. Rule 502 may specify conditions based on the amount of solid material, whether the material is magnetic or non-magnetic, and based on a color of fluid sample 64. For example, rule 502 may be satisfied when fluid sample 64 of an engine coolant has brown color, and a trace amount of non-magnetic solid material. It is contemplated that rule 502 may include one or more other conditions based on the amount of solid material, magnetic properties, and color of fluid sample 64.

Rule 504 may specify conditions related to the opacity of fluid sample 64. For example, based on the measurements obtained by test apparatus 58, fluid sample 64 may be classified as being transparent, cloudy, or opaque. In one exemplary embodiment, rule 504 may be satisfied when a fluid sample 64 is transparent or cloudy, but not when fluid sample 64 is opaque. It is contemplated that rule 504 may include one or more other conditions based on opacity of fluid sample 64.

Rule 506 may specify conditions related to an amount of foam in fluid sample 64. For example, based on the measurements obtained by test apparatus 58, an amount of foam in fluid sample 64 may be classified as normal or light. Thus, for example, an amount of foam in fluid sample 64, as determined by test apparatus 58, may be deemed normal if it exceeds a foam threshold. In one exemplary embodiment, rule 506 may be satisfied when fluid sample 64 has a "normal" amount of foam. It is contemplated that rule 506 may include one or more other conditions based on the amount of foam in fluid sample 64.

Rule 508 may specify conditions related to an amount of oil in fluid sample 64. For example, the amount of oil in fluid sample 64 as determined by test apparatus 58 may be labeled "Trace," when it is less than an oil threshold and "Present," when the amount of oil is greater than or equal to the oil threshold. Rule 508 may be satisfied, for example, when fluid sample 64 includes "Trace" amounts of oil, but not when fluid sample 64 includes more than a "Trace" amount of oil. It is contemplated that rule 508 may include one or more other conditions based on the amount of oil in fluid sample 64.

Rule 510 may specify conditions related to an amount of ammonia in fluid sample 64. For example, the amount of ammonia in fluid sample 64 as determined by test apparatus 58 may be labeled "Trace," when it is less than an ammonia threshold and "Present," when the amount of ammonia exceeds the ammonia threshold. Rule 510 may be satisfied, for example, when fluid sample 64 includes "Trace" amounts of ammonia, but not when fluid sample 64 includes more than a "Trace" amount of ammonia. It is contemplated that rule 510 may include other conditions based on the amount of ammonia in fluid sample 64.

Rule 512 may specify conditions related to an amount of glycol in fluid sample 64. For example, the amount of glycol in fluid sample 64 may be determined to be in "Grange 1," when the amount of glycol in fluid sample 64 is less than a first glycol threshold. The amount of glycol in fluid sample 64 may be determined to be in "Grange 2," when the amount of glycol in fluid sample 64 ranges between the first glycol threshold and a second glycol threshold. Likewise the amount of glycol in fluid sample 64 may be determined to be in "Grange 3," when the amount of glycol in fluid sample 64 ranges between the second glycol threshold and a third glycol threshold. Fewer or more ranges based on the amount of glycol may be included in rule 512. Rule 512 may be satisfied, for example, when fluid sample 64 includes glycol in ranges Grange 1 or Grange 2 but not in any of the other ranges. It is contemplated that rule 512 may include one or more other conditions based on the amount of glycol in fluid sample 64.

Rule 514 may specify conditions related to a pH value of fluid sample 64. A pH value may represent acidity or basicity of fluid sample 64. For example, a pH value of fluid sample 64 may be determined to be in range "$pH_1$," when the pH value is less than a first pH threshold. The pH value of fluid sample 64 may be determined to be in range "$pH_2$," when the pH value ranges between the first pH threshold and a second pH threshold. Likewise the pH value of fluid sample 64 may be determined to be in range "$pH_3$," when the pH value ranges between the second pH threshold and a third pH threshold. Fewer or more ranges based on pH value may be included in rule 514. Rule 514 may be satisfied, for example, when a pH value of fluid sample 64 lies in one of ranges $pH_1$ or $pH_2$, but not in the other pH ranges. It is contemplated that rule 514 may include one or more other conditions based on the pH value of fluid sample 64.

Rule 516 of rule-set 500 may relate to characteristics representing amounts of nitrates, carbonates, chlorides, or silicates in fluid sample 64. Rule 516 may be satisfied, for example, when one or more of the amounts of nitrates, carbonates, chlorides, and silicates in fluid sample 64 are less than corresponding threshold amounts of nitrates, carbonates, chlorides, and silicates, respectively.

Rule 518 may be related to characteristics representing amounts of various elements in fluid sample 64. For example, rule 518 may be satisfied when values of Fe (an amount of iron), Cu (an amount of copper), Al (an amount of aluminum), Pb (an amount of lead), Zn (an amount of zinc), and Sn (an amount of tin) are less than their corresponding threshold values "$Fe_{MAX}$," "$Cu_{MAX}$," "$Al_{MAX}$," "$Pb_{MAX}$," "$Zn_{MAX}$," and "$Sn_{MAX}$," respectively. It is contemplated that rule 518 may also include rules for fewer elements or more elements than the elements, iron, copper, aluminum, lead, zinc, and tin illustrated in FIG. 5. Although only rules 502-518 have been illustrated in FIG. 5, it is contemplated that rule-set 500 may include any number of rules.

In one exemplary embodiment, an engine coolant from machine 10 may be labeled "Normal," only when a test result corresponding to fluid sample 64 of the engine coolant satisfies each of the plurality of rules (e.g. 502-518), in rule-set 500. The engine coolant may be labeled "Abnormal" when at least one of the rules 502-518 in rule-set 500 is not satisfied by the test result corresponding to fluid sample 64. In other exemplary embodiments, engine coolant may be labeled "Normal," when the test result of fluid sample 64 satisfies a subset of rules selected from rule-set 500. For example, in some exemplary embodiments, the engine coolant may be labeled "Normal" if the test result of fluid sample 64 satisfies rules 502, 504, at least one of rules 506-507, and at least one of rules 514 and 516.

In addition to rule-sets 400, 500, database 60 of maintenance system 50 may store historical test results collected on a plurality of fluid samples 64 obtained from one or more machines 10 over a period of time. Database 60 may also store, for example, estimates of useful life of a fluid (obtained from machine 10) or of a machine component of machine 10. Such estimates may be generated by one or more operators 86 based on the test results of fluid samples 64 obtained from machine 10 and any associated maintenance, wear, or failure information reported for machine 10. For example, the historical test data may indicate that an engine lubricant should be replaced when an amount of copper in the engine lubricant exceeds a copper threshold. Database 60 may include correlations of the values of one or more other characteristics discussed above in connection with rule-sets 400, 500, and information regarding durations after which one or more fluids of machine 10 may require replacement.

Returning to FIG. 3, analysis system 54 may include controller 72, input device 74, display device 76, communication device 78, and alert device 80. Analysis system 54 may be operated by operator 86. Controller 72 may include processor 82 and storage device 84. Processor 82 may be configured to control operations of storage device 84, input device 74, display device 76, communication device 78, and alert device 80. Storage device 84 may store data and/or instructions that processor 82 may be configured to execute to perform a variety of operations. Additionally or alternatively, processor 82 may execute instructions stored in database 60. Processor 82 may receive data from database 60 and may perform maintenance analysis on the data received from database 60 based on instructions received from storage device 84 and/or database 60. Input device 74, display device 76, alert device 80, processor 82, storage device 84, and communication device 78 may have structures and functions similar to those described above for input device 34, display device 36, alert device 38, processor 42, storage device 44, and communication device 40, respectively. In one exemplary embodiment, communication device 78 may include an antenna, which may help controller 72 send information to and receive information from controller 32 of console 28 in machine 10. For example, controller 72 may send instructions to controller 32 to display messages to operator 30 of machine 10 on display device 36. In some exemplary embodiments, controller 72 may also send instructions to controller 32 to generate an audio alert, a visual alert, or an audio-visual alert using alert device 38. In other exemplary embodiments, controller 72 may send instructions to controller 32 via communication devices 78, 40 to activate alert device 38 and provide an audio alert, a visual alert, or an audio-visual alert to operator 30 of console 28.

Controller 72 may perform a variety of mathematical operations on the historical data stored in database 60 to derive correlations, regressions, numerical models, mathematical relationships, look-up tables, etc. of the one or more characteristics with time. Controller 72 may also correlate values of one or more characteristics obtained from the historical data with the fluid condition of a fluid or the component condition of a component. As used in this disclosure the phrase "fluid condition" may represent a capability of the fluid to perform its desired function in machine 10. Thus, for example, the fluid condition may indicate a degree to which the fluid in machine 10 has degraded or decomposed and whether the fluid in machine 10 should be replaced. Further, as used in this disclosure the phrase "component condition" may represent a capability of the component to perform its desired function in machine 10. Thus, for example, the component condition may indicate that a degree to which the component in machine 10 is worn out and whether the component in machine 10 should be replaced. Controller 72 may perform these mathematical operations upon receiving an input from operator 86 or autonomously on a periodic basis. For example, controller 72 may perform these mathematical operations on a daily, weekly, or monthly basis, or when database 60 receives a new set of test results. It is also contemplated that correlations, regressions, numerical models, mathematical relationships, look-up tables, etc. may be received by controller 72 by operator 86 via input device 74. Database 60 may store the correlations, regressions, numerical models, mathematical relationships, look-up tables, etc. generated by controller 72.

Figure 6:
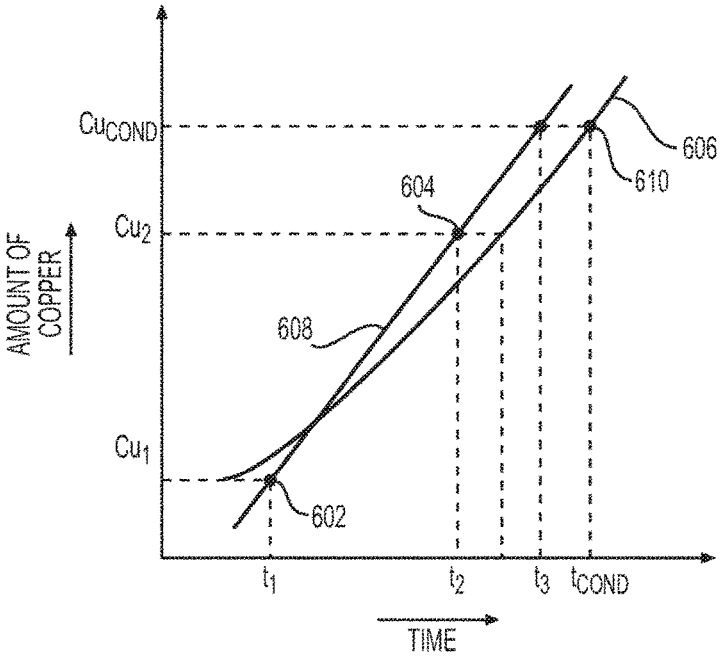
FIG. 6 is a pictorial illustration of an exemplary correlation between an amount of copper and time for a fluid of the machine of FIG. 1.

FIG. 6 illustrates an exemplary correlation between an amount of copper and time for an exemplary fluid (e.g. engine lubricant). As illustrated in FIG. 6, an amount of copper may be expected to increase in a fluid in machine 10 over time. For example, data point 602 illustrated in FIG. 6 shows that an amount of copper in fluid sample 64 obtained from machine 10 at time "$t_1$" may be "$Cu_1$." Similarly, for example, data point 604 in FIG. 6 shows that the amount of copper in fluid sample 64 obtained from the same machine 10 at time "$t_2$" may be "$Cu_2$." FIG. 6 may include correlation 606, which may represent the variation of Cu over time expected in a typical machine 10. In one exemplary embodiment as illustrated by data point 610 in FIG. 6, an amount of copper "$Cu_{COND}$" may correspond to a fluid condition at which engine lubricant may no longer be able to sufficiently lubricate components of engine 12. Thus, for example, at time $t_{COND}$, engine lubricant in engine 12 may require replacement. The value of $t_{COND}$ may be determined by controller 72 based on an analysis of historical data on, for example, amounts of copper in fluid samples 64 of engine lubricant obtained from machine 10, information regarding lubrication capabilities relative to chemical composition of engine lubricants, and/or inputs received from operator 86 of maintenance system 50. Controller 72 may compare the amount of copper $Cu_2$ with the correlation of FIG. 6 to determine a fluid condition. For example, controller 72 may determine the fluid condition to be one of low degradation, medium degradation, or high degradation depending on the difference between the amount of copper $Cu_2$ and the amount of copper $Cu_{COND}$ or based on a difference between time $t_2$ and time $t_{COND}$.

In one exemplary embodiment, controller 72 of maintenance system 50 may compare amounts of copper $Cu_1$ and $Cu_2$ of fluid samples 64 obtained from machine 10 to the correlation 606 of FIG. 6 to determine a fluid condition of the engine lubricant in machine 10. For example, controller 72 may generate a correlation 608 based on the measured characteristics ($Cu_1$, $t_1$) and ($Cu_2$, $t_2$). It is contemplated that correlation 608 may include one of linear regression, polynomial regression, or any other type of mathematical model to represent the measured characteristics ($Cu_1$, $t_1$) and ($Cu_2$, $t_2$). Controller 72 may project correlation 608 to determine the time "$t_3$" at which an amount of copper in fluid sample 64 obtained from machine 10 may be expected to be about equal to $Cu_{COND}$. As used in this disclosure the phrase "about equal" indicates equality within manufacturing or measurement tolerances known in the art. For example, two quantities may be about equal when they differ by less than ±0.1%. As illustrated in FIG. 6, time $t_3$ may be different from $t_{COND}$ expected for a typical machine. Controller 72 may determine a duration $t_{useful}$ after which the engine lubricant in machine 10 may need replacement as $t_{useful}=t_3-t_2$. Controller 72 may cooperate with controller 32 to notify operator 30 of the estimated duration $t_{useful}$, for example, alert device 38. Operator 30 may schedule maintenance for machine 10 based on the notification to help ensure minimum disruption in service by machine 10. For example, operator 30 may schedule maintenance for machine 10 during a planned idle time for machine 10 that lies within two or three days of time $t_3$.

Figure 7:
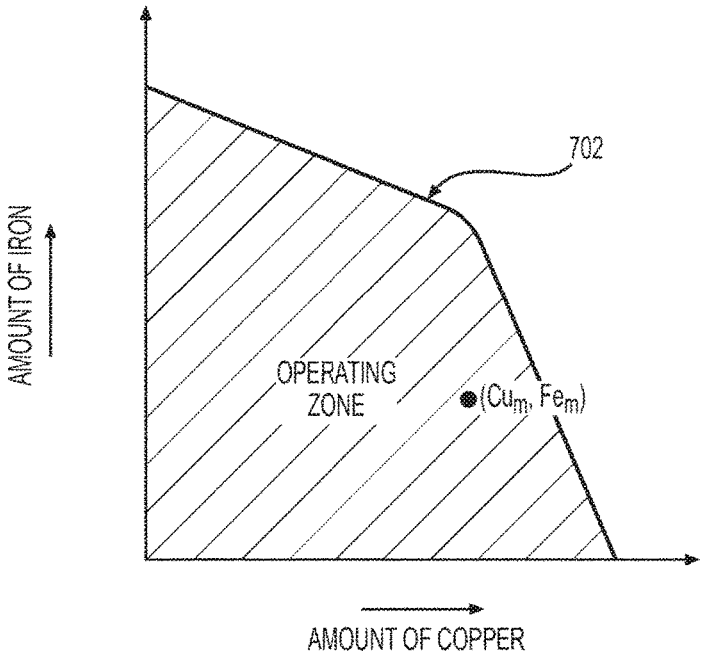
FIG. 7 is a pictorial illustration of an exemplary correlation between an amount of copper and amount of iron for a fluid of the machine of FIG. 1.

Controller 72 may also compare the measured characteristics of fluid sample 64 of machine 10 to other types of correlations to determine, for example, a component condition of an engine component (e.g. piston) of machine 10. FIG. 7 illustrates an exemplary correlation 702 between amounts of iron and amounts of copper in a fluid (e.g. engine lubricant). As illustrated in FIG. 7, when the amounts of iron and copper lie outside the operating zone (shown hatched), severe wear of an engine component (e.g. piston) may be indicated. Thus, for example, as illustrated in FIG. 7, controller 72 may compare the measured amounts of iron "$Fe_M$" and copper "$Cu_M$" in fluid sample 64 to correlation 702 between iron and copper, for example, as shown in FIG. 7 to determine a component condition of the engine component. In one exemplary embodiment, controller 72 may determine the component condition to be one of low wear, medium wear, or high wear depending on a comparison of the measured amounts of iron and copper with correlation 702. Controller 72 may also compare the amounts $Fe_M$ and copper $Cu_M$ with correlations (e.g. 606) of amounts of copper and iron with time as shown in, for example, FIG. 6 to determine a duration after which the engine component (e.g. piston) may require repair or replacement. Controller 72 may cooperate with controller 32 to notify operator 30 of the component condition and/or the duration after which the engine component of machine 10 should be repaired or replaced using, for example, alert device 38. Operator 30 may schedule maintenance for machine 10 for repair or replacement of the engine component based on the notification to help ensure minimum disruption of service by machine 10. In particular, operator 30 may order the replacement parts and schedule maintenance for machine 10, for example, during an idle period of machine 10 before expiry of the duration determined by controller 72.

Although exemplary correlations of amounts of copper and iron have been discussed above with respect to FIGS. 6 and 7, it is contemplated, that database 60 may store correlations in the form of mathematical expressions, algorithms, look-up tables, charts, etc., for any of the characteristics discussed above with respect to rule-sets 400, 500. It is also contemplated that database 60 may store the temporal variations of these characteristics based on historical data associated with fluid samples 64 obtained from the same or different machines 10. Further, database 60 may store conditions or criteria based on correlations of historical data to determine durations after which one or more of fluids such as engine lubricant, transmission oil, gear oil, hydraulic fluid, engine coolant, etc., associated with machine 10 may require replacement. It is also contemplated that database 60 may store conditions or criteria based on correlations of historical data to determine durations after which one or more components (e.g. pistons, connecting rods, bearings, etc.) of machine 10 may require repair or replacement.

In some exemplary embodiment, controller 72 may be configured to cooperate with controller 32 of machine 10 to transmit an alert to alert device 38 upon detecting that one or more of the rules in the selected rule-set are not satisfied. For example, when fluid sample 64 includes engine coolant, and controller 72 determines that a pH value of fluid sample 64 exceeds a pH threshold (e.g. first pH threshold or second pH threshold of rule 514), controller 72 may transmit an alert to alert device 38. Controller 72 may also determine an amount of water required to alter the pH value of the engine coolant to the pH threshold. Controller 72 may determine the amount of water based on information, stored in database 60, regarding an amount of engine coolant typically carried by machine 10 from which fluid sample 64 was obtained. Controller 72 may cooperate with controller 32 of machine 10 to transmit a message to operator 30 of machine 10 via alert device 38, indicating the amount of water to be added to the engine coolant in machine 10.

As another example, controller 72 may determine that an amount of precipitate in fluid sample 64 of an engine coolant from machine 10 exceeds a precipitate threshold and that the precipitate is magnetic (see rule 502 in FIG. 5). Controller 72 may cooperate with controller 32 of machine 10 to transmit a message to operator 30 of machine 10 via alert device 38, indicating that a cooling system of machine 10 should be flushed and that the engine coolant in machine 10 should be replaced. It is contemplated that controller 72 may transmit a variety of other alert messages to operator 30 when one or more rules in rule-sets 400, 500 are not satisfied by the test result for fluid sample 64. Such alert messages may help operator 30 take immediate remedial action, which may help prevent further damage to the components of machine 10.

INDUSTRIAL APPLICABILITY

The maintenance system of the present disclosure may be used to perform measurements of various characteristics of fluids, for example, engine lubricant, coolant, transmission oil, gear oil, brake fluid, hydraulic fluid, etc., associated with a machine. In particular, the measured characteristics may be used to determine whether any of the fluids need to be replaced or topped off. Further, the measured characteristics may be used to determine a fluid condition of one or more of the fluids or a component condition of one or more machine components. The measured characteristics may also be used to schedule maintenance on a machine for repair or replacement with minimum disruption to scheduled operations of machine 10. Exemplary methods of operation of maintenance system 50 will be discussed below.

Figure 8:
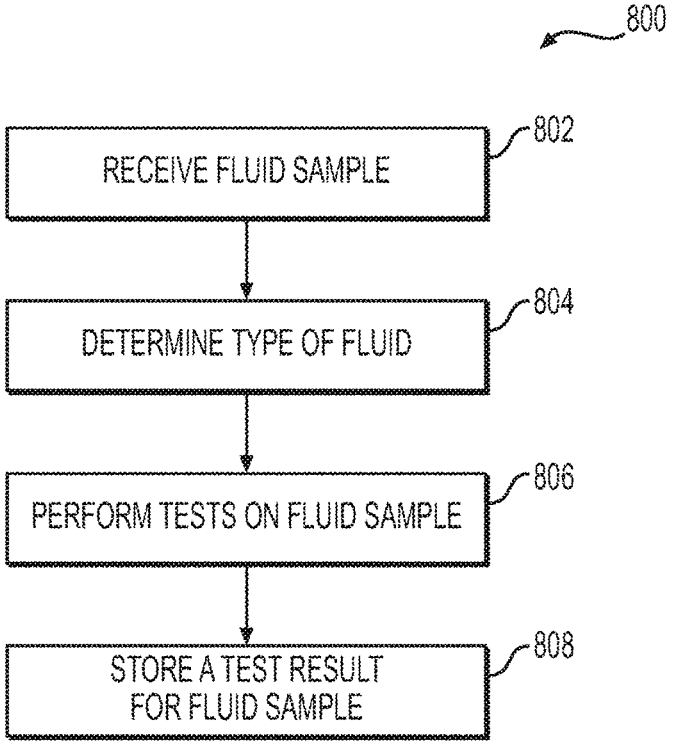
FIG. 8 is an exemplary flow chart of a method performed by the maintenance system of FIG. 3 for testing fluid samples obtained from the machine of FIG. 1.

FIG. 8 illustrates an exemplary method 800 of determining a test result for a fluid sample 64 performed by maintenance system 50. Method 800 may include a step of receiving fluid sample 64 (Step 802). Maintenance system 50 may receive fluid sample 64, which may include, for example, one of an engine lubricant, transmission oil, gear oil, hydraulic fluid, brake fluid, or engine coolant from an owner or operator 30 of machine 10. It is contemplated that maintenance system 50 may receive fluid sample 64 on a one time basis or on a periodic basis. It is also contemplated that maintenance system 50 may receive one fluid sample 64 of a fluid (e.g. engine lubricant, transmission oil, gear oil, brake fluid, hydraulic fluid, or engine coolant), a plurality of fluid samples 64 of the same fluid, or a plurality of fluid samples 64 of different fluids from machine 10.

Method 800 may include a step of determining a type of fluid in fluid sample 64. For example, controller 72 may determine whether fluid sample 64 includes a sample of engine lubricant, transmission oil, gear oil, hydraulic fluid, brake fluid, or engine coolant. In one exemplary embodiment, controller 72 may determine the type of fluid corresponding to fluid sample 64 based on inputs received from input device 74. In another exemplary embodiment, controller 72 may determine the type of fluid based on information provided by operator 30 of machine 10. In some exemplary embodiments, controller 72 may also determine a subtype of fluid corresponding to fluid sample 64. For example, when the type of fluid in fluid sample 64 is determined to be an engine coolant, controller 72 may determine the subtype of the engine coolant. The subtype may include one of conventional coolant, diesel engine antifreeze coolant (DEAC), extended life coolant (ELC), etc. Although a subtype of fluid has been described above with respect to an engine coolant, it is contemplated that subtype of fluid may be associated with fluids such as engine lubricant, transmission oil, gear oil, hydraulic fluid, brake fluid. For example, the subtype for an engine lubricant may be based on different brands of engine lubricant, different chemical compositions of engine lubricant, etc.

Method 800 may include a step of performing tests on fluid sample 64 (Step 806). Controller 72 of maintenance system 50 may perform one or more tests on fluid sample 64 using one or more test apparatuses 58. In one exemplary embodiment, when fluid sample 64 includes one of engine lubricant, transmission oil, gear oil, hydraulic fluid, or brake fluid, controller 72 may perform tests to determine values of characteristic included in, for example, rule-set 400. In another exemplary embodiment, when fluid sample 64 includes an engine coolant, controller 72 may perform tests to determine values of characteristics included in, for example, rule-set 500. In yet another exemplary embodiment, controller 72 may command test apparatus 58 to perform tests on fluid sample 64 based on one or more inputs received from input device 74. For example, operator 86 of maintenance system 50 may specify the characteristics to be determined for fluid sample 64 using input device 74.

Controller 72 may store a test result (i.e. values of characteristics) for fluid sample 64 obtained from test apparatuses 58 in database 60 (Step 808). The test result may include the type of fluid of fluid sample 64, the subtype of fluid of fluid sample 64, and values of the characteristics for fluid sample 64. Controller 72 may store the test result in association with an identifier of fluid sample 64 in a record in database 60. Controller 72 may also store other information, for example, a model number or description, a serial number, a model year, and/or other sales or ownership related information corresponding to machine 10 from which fluid sample 64 was obtained in association with the identifier of fluid sample 64 in database 60. In addition, controller may store information such as the date and/or time when fluid sample 64 was extracted from machine 10, the date and/or time when fluid sample 64 was tested, information regarding operator 86, etc. Controller 72 may repeat steps 802 through 808 of method 800 for each fluid sample 64 received by maintenance system 50.

Figure 9:
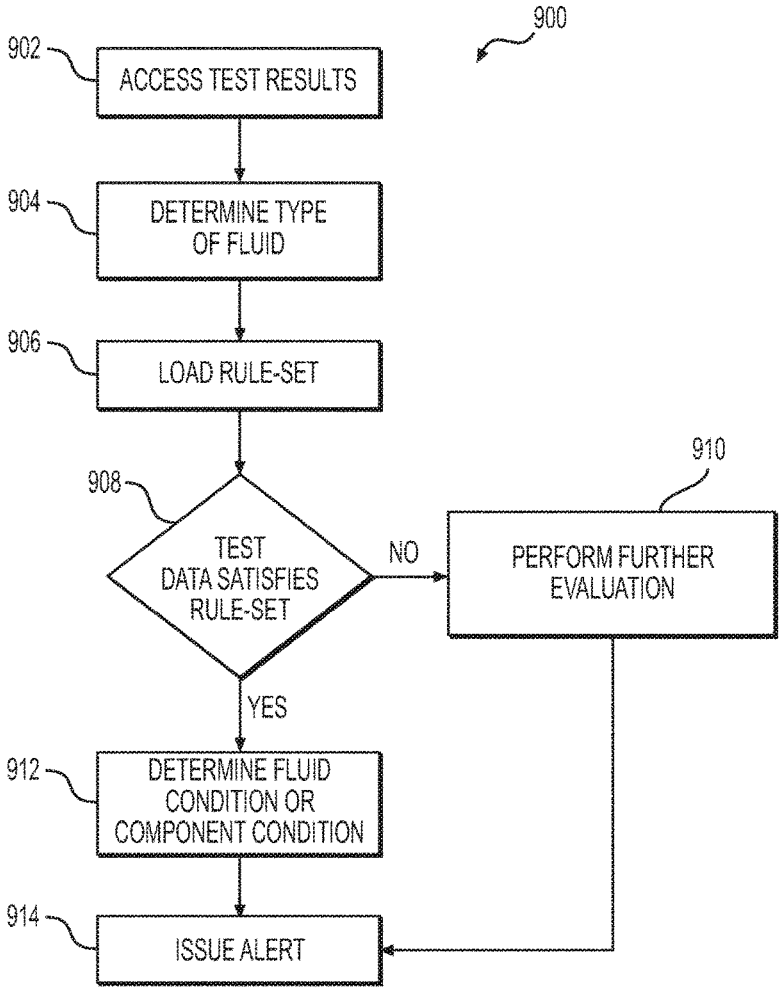
FIG. 9 is an exemplary flow chart of a method of fluid sample monitoring performed by the maintenance system of FIG. 3 based on the test results obtained using the method of FIG. 8.

FIG. 9 illustrates another exemplary method 900 of monitoring a machine 10 performed by maintenance system 50. Method 900 may include a step of accessing a test result for a fluid sample 64 (Step 902). Controller 72 may access or receive a record including the test result for fluid sample 64 from database 60 associated with maintenance system 50. It is contemplated that controller 72 may access or receive a record including the test result for fluid sample 64 from storage device 84. It is also contemplated that controller 72 may receive the test result for fluid sample 64 based on inputs received via input device 74.

Method 900 may include a step of determining a type of fluid corresponding to fluid sample 64 (Step 904). Thus, for example, controller 72 may determine whether fluid sample 64 includes a sample of engine lubricant, transmission oil, gear oil, hydraulic fluid, brake fluid, or engine coolant. In one exemplary embodiment, controller 72 may determine the type of fluid from data stored in the record containing the test result for fluid sample 64. In some exemplary embodiments, controller 72 may also determine the subtype of fluid from data stored in the record containing the test result for fluid sample 64. In yet other exemplary embodiments, controller 72 may determine the type and the subtype corresponding to fluid sample 64 based on inputs received from input device 74.

Method 900 may include a step of loading rule-set 400 or 500 (Step 906). Controller 72 may access rule-set 400 or 500 from database 60 based on the type and/or subtype of fluid of fluid sample 64. For example, when fluid sample 64 includes one of engine lubricant, transmission oil, gear oil, hydraulic fluid, or brake fluid, controller 72 may access rule-set 400 from database 60. Alternatively, when fluid sample 64 includes, for example, engine coolant, controller 72 may access rule-set 500 from database 60. In some exemplary embodiments, controller 72 may select a particular rule-set 400 or 500 based on the subtype of fluid determined, for example, in step 904. In other exemplary embodiments, controller 72 may also select a subset of rules from the accessed rule-set. The subset of rules may be selected based on inputs received from operator 86 via input device 74.

Method 900 may include a step of determining whether the test result satisfies rule-set 400 or 500 (Step 908). Controller 72 may access values of the various characteristics in the test result for fluid sample 64 from the record received in, for example, step 902. Controller 72 may compare the value of the characteristics with the threshold values of those characteristics based on the criteria specified in rule-set 400 or 500. When fluid sample 64 includes engine lubricant, transmission oil, gear oil, brake fluid, or hydraulic fluid, controller 72 may compare the characteristic values of fluid sample 64 with the threshold values specified in rules 402-412. For example, controller 72 may determine whether an amount of water W in fluid sample 64 is less than a threshold amount of water $W_{MAX}$ as required by rule 402. Controller 72 may perform similar comparisons based on each of rules 402-412. When controller 72 determines that the characteristic values corresponding to fluid sample 64 satisfy each of rules (e.g. 402-412 or 502-518) in rule-set 400, 500 (Step 908: Yes), controller 72 may label fluid sample 64 "Normal" and proceed to step 910. In some exemplary embodiments, controller 72 may label fluid sample 64 "Normal" when the test result for fluid sample 64 satisfies each rule in the subset of rules selected, for example, in step 906. To label fluid sample 64 as "Normal," controller 72 may add the label "Normal" to the record containing the test result for fluid sample 64 in database 60.

When controller 72 determines, however, that the characteristic values corresponding to fluid sample 64 do not satisfy at least one of rules (e.g. 402-412 or 502-518) in rule-set 400, 500 (Step 908: No), controller 72 may label fluid sample 64 "Abnormal" and proceed to step 910. In step 910, controller 72 may store the test results corresponding to fluid sample 64 together with the "Abnormal" label in database 60. Controller 72 may notify an operator 86 of maintenance system 50 that fluid sample 64 requires additional evaluation. In other exemplary embodiments, controller 72 may notify operator 86 regarding all fluid samples 64 labeled "Abnormal" after analyzing a plurality of records from database 60. When operator 86 receives a notification of abnormal samples from analysis system 54, operator 86 may review and perform further analysis on the test data for the fluid samples 64 labeled "Abnormal." Based on such analysis, operator 86 may revise the label for one or more such samples to "Normal." It is also contemplated that operator 86 may not change the labels of some or all such samples based on the review. When operator 86 determines that the test results are indicative of imminent failure of one or more components of machine 10, operator 86 may command controller 72, via input device 74, to issue an alert to operator 30 of machine 10. Controller 72 may proceed to step 914 to issue an alert in response to the inputs received from operator 86.

Returning to step 908, when controller 72 determines that the test data for fluid sample 64 satisfies the rule-set 400 or 500 (Step 908: Yes), controller 72 may proceed to step 912 of determining a fluid condition of fluid sample 64 or of a component of machine 10. Controller 72 may access or receive correlations related to the one or more characteristics from database 60. It is contemplated that controller 72 may access or receive the correlations from storage device 84. Controller 72 may determine the fluid condition of fluid sample 64 or the component condition of a component of machine 10 using the processes discussed above with respect to FIGS. 6 and 7. Controller 72 may also determine a duration after which a fluid or a component in machine 10 may require replacement using the processes discussed above with respect to FIGS. 6 and 7.

Method 900 may also include a step of issuing an alert (Step 914). Thus, for example, controller 72 may transmit instructions and/or data via communication device 68 to console 28 of machine 10 to generate an audio alert, a visual alert, or an audio-visual alert on display 36. In one exemplary embodiment, the alert may include textual or visual information regarding the fluid condition or component condition determined in, for example, step 912. The alert may also include recommendations regarding a time when maintenance for machine 10 may be scheduled based on the fluid condition or component condition determined in, for example, step 912. In another exemplary embodiment, the alert may include textual or visual information regarding imminent failure of a machine component as determined in, for example, step 910. In some exemplary embodiments, the alert may include textual or visual information regarding remedial steps that operator 30 may take (e.g. an amount of water that should be added to the engine coolant, flushing of the engine coolant system and replacement of the engine coolant, etc.)

It will be apparent to those skilled in the art that various modifications and variations can be made to the disclosed engine coolant monitoring system without departing from the scope of the disclosure. Other embodiments of the engine coolant monitoring system will be apparent to those skilled in the art from consideration of the specification and practice of the engine coolant monitoring system disclosed herein. It is intended that the specification and examples be considered as exemplary only, with a true scope of the disclosure being indicated by the following claims and their equivalents.

What is claimed is:

1. An engine coolant monitoring system for a machine, comprising:

a test device configured to test a fluid sample of an engine coolant from the machine;

a database configured to store a test result generated by the test device, the test result including a plurality of characteristics of the fluid sample; and a controller configured to:

determine a subtype of the engine coolant from among a plurality of subtypes;

select a rule-set corresponding to the determined subtype of the engine coolant from the database, the rule-set including criteria associated with the characteristics;

determine whether characteristics of the fluid sample satisfy the criteria;

label the engine coolant as normal when the characteristics of the fluid sample satisfy the criteria;

label engine coolant as abnormal when the characteristics do not satisfy at least one criterion included in the rule-set;

transmit the label to the machine; and activate an alert device on the machine to generate an alert based on the transmitted label.

2. The engine coolant monitoring system of claim 1, wherein the plurality of subtypes includes a conventional coolant, a diesel engine antifreeze coolant, and an extended life coolant.

3. The engine coolant monitoring system of claim 2, wherein the controller is configured to label the engine coolant as normal when each of the criteria in the rule-set is satisfied.

4. The engine coolant monitoring system of claim 2, wherein the controller is configured to:

select a subset of criteria from the criteria included in the rule-set; and label the engine coolant as normal when the subset of criteria is satisfied.

5. The engine coolant monitoring system of claim 1, wherein the characteristics include at least one of an amount of precipitate, an opacity, an amount of foam, an amount of oil, an amount of ammonia, an amount of glycol, a pH value, an amount of nitrate, an amount of carbonate, an amount of chloride, an amount of silicate, an amount of iron, an amount of copper, an amount of aluminum, an amount of lead, an amount of zinc, or an amount of tin.

6. The engine coolant monitoring system of claim 5, wherein the controller is further configured to:

determine whether the pH value of the fluid sample is less than a pH threshold; and determine an amount of water to be added to the engine coolant based on the pH value.

7. The engine coolant monitoring system of claim 5, wherein the rule-set includes:

a first criterion requiring the amount of precipitate to be less than a precipitate threshold;

a second criterion requiring the opacity to be one of transparent or cloudy;

a third criterion requiring the amount of foam to be less than a foam threshold;

a fourth criterion requiring the amount of oil to be less than an oil threshold;

a fifth criterion requiring the amount of ammonia to be less than an ammonia threshold;

a sixth criterion requiring the amount of glycol to be less than a glycol threshold; and a seventh criterion requiring the pH value to be less than a pH threshold.

8. The engine coolant monitoring system of claim 7, wherein the rule-set further includes an eighth criterion requiring amounts of nitrates, carbonates, chlorides, and silicates to be less than respective thresholds of nitrates, carbonates, chlorides, and silicates.

9. The engine coolant monitoring system of claim 8, wherein the rule-set further includes a ninth criterion requiring amounts of iron, copper, aluminum, lead, zinc, and tin to be less than respective threshold amounts of iron, copper, aluminum, lead, zinc, and tin.

10. The engine coolant monitoring system of claim 1, wherein the controller is further configured to transmit an alert to the machine when the engine coolant is labeled abnormal.

11. The engine coolant monitoring system of claim 10, wherein transmitting the alert includes displaying a message on a display device associated with the machine.

12. The engine coolant monitoring system of claim 11, wherein the message includes recommendations changing the engine coolant of the machine.

13. The engine coolant monitoring system of claim 11, transmitting the alert further includes generating an audible alert using an alert device associated with the machine.

14. A method of monitoring an engine coolant in a machine, comprising:

extracting a fluid sample of the engine coolant from the machine;

testing the fluid sample using at least one test apparatus;

generating a test result, including a plurality of characteristics of the fluid sample;

storing the test result in a database;

determining, using a controller, a subtype of the engine coolant from among a plurality of subtypes;

selecting, using the controller, a rule-set corresponding to the determined subtype of the engine coolant from the database, the rule-set including criteria associated with the characteristics;

determining whether characteristics of the fluid sample satisfy the criteria;

labeling the engine coolant as normal when the characteristics of the fluid sample satisfy the criteria;

labeling the engine coolant as abnormal when the characteristics do not satisfy at least one criterion included in the rule-set;

transmitting the label to the machine; and activating an alert device on the machine to generate an alert based on the transmitted label.

15. The method of claim 14, wherein the plurality of subtypes includes a conventional coolant, a diesel engine antifreeze coolant, and an extended life coolant.

16. The method of claim 15, wherein the characteristics include at least one of an amount of precipitate, an opacity, an amount of foam, an amount of oil, an amount of ammonia, an amount of glycol, a pH value, an amount of nitrate, an amount of carbonate, an amount of chloride, an amount of silicate, an amount of iron, an amount of copper, an amount of aluminum, an amount of lead, an amount of zinc, or an amount of tin.

17. The method of claim 15, further including:

determining whether a pH value of the fluid sample is less than a pH threshold; and determining an amount of water to be added to the engine coolant based on the pH value.

18. The method of claim 15, further including:

determining whether an amount of a precipitate in the fluid sample exceeds a precipitate threshold;

determining whether the precipitate is magnetic; and transmitting an alert to the machine when the amount of precipitate exceeds the precipitate threshold and the precipitate is magnetic.

19. The method of claim 18, wherein transmitting the alert includes displaying a message on a display device associated with the machine.

20. The method of claim 19, further including:

selecting a subset of criteria from the criteria included in the rule-set; and labeling the engine coolant as normal when the subset of criteria is satisfied.

* * * * *